United States Patent [19]

Zenri

[11] 4,273,273

[45] Jun. 16, 1981

[54] HAND CARRIER FOR CANS OR BOTTLES

[76] Inventor: Hideomi Zenri, No. 32-12, 2-chome, Kaminakazato, Kita-ku, Tokyo, Japan

[21] Appl. No.: 925,164

[22] Filed: Jul. 17, 1978

[30] Foreign Application Priority Data

Feb. 8, 1978 [JP] Japan ..... 53-13246

[51] Int. Cl.[3] ..... B65D 71/00

[52] U.S. Cl. ..... 294/87.2; 206/434; 224/40; 229/28 BC

[58] Field of Search ..... 224/45 AA, 45 A, 45 BA, 224/45 R; 229/40, 52 BC, 28 BC; 294/87.2; 206/434

[56] References Cited

U.S. PATENT DOCUMENTS

| | | | |
|---|---|---|---|
| 1,702,199 | 2/1929 | Cunningham | 224/45 BA |
| 2,227,780 | 1/1941 | Hickman et al. | 224/45 BA |
| 3,398,856 | 8/1968 | Graser | 229/40 X |

FOREIGN PATENT DOCUMENTS

| | | | |
|---|---|---|---|
| 1915479 | 11/1969 | Fed. Rep. of Germany | 224/45 BA |
| 1433544 | 2/1966 | France | 224/45 BA |
| 288319 | 3/1965 | Netherlands | 224/45 BA |
| 6800147 | 7/1968 | Netherlands | 224/45 BA |

*Primary Examiner*—Robert J. Spar
*Assistant Examiner*—Jerold M. Forsberg
*Attorney, Agent, or Firm*—Kerkam, Stowell, Kondracki & Clarke

[57] ABSTRACT

A hand carrier used for carrying cans or bottles of drinks, for example, cola, juice, beer or the like. The present hand carrier is so constructed that it grips the circumferential projections of the cans or bottles, for example, the crown caps of bottles or the projected edge at either end of cans. The hand carrier can be made of lesser amount of paper material than the conventional box-type hand carrier and strongly grips the cans or bottles and allows them to be carried safely.

7 Claims, 5 Drawing Figures

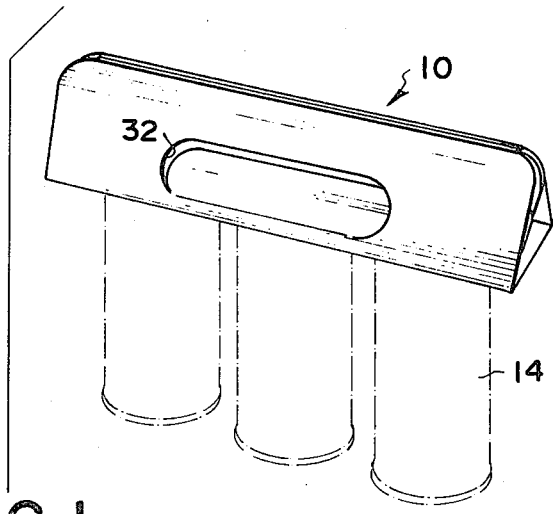
FIG. 1
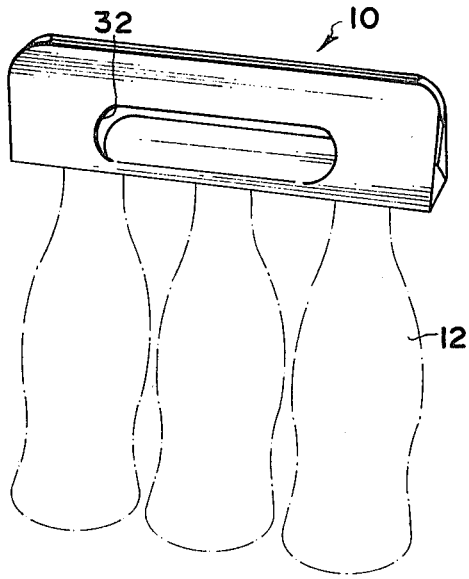
FIG. 3
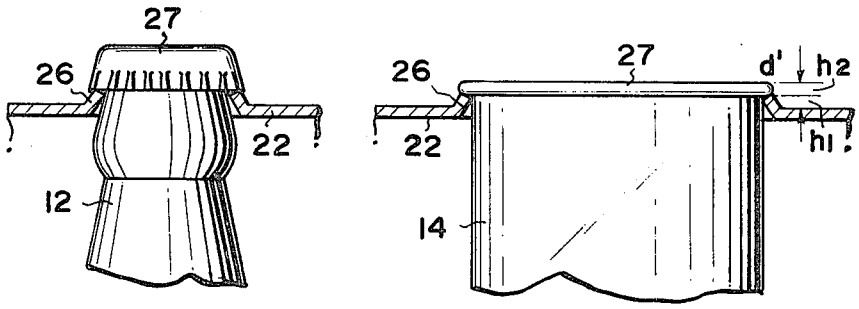

HAND CARRIER FOR CANS OR BOTTLES

This invention relates to a hand carrier for containers, for example, cans or bottles of cola, juice or beer.

Heretofore, a box-type hand carrier open at the top has been widely used. Such type of hand carrier is generally made of pasteboard and supports the cans and bottles at their bottoms and surrounds the major portion of their bodies. Therefore, a large square of pasteboard is required for making such a box-type hand carrier. Since hand carriers are usually thrown away after use, a hand carrier, such as the box-type carrier, requiring a great amount of paper material is very wasteful.

Recently, another type of hand carrier which can grip the upper ends of cans or bottles has been developed. Such type of hand carrier can be made with lesser amount of paper material than the conventional box-type hand carrier, since it does not require provision of side wall portion for surrounding the major portion of bodies of the cans or bottles. However, such type of hand carrier heretofore developed has a fault; the gripping force on the cans or bottles is insufficient and therefore the user cannot always carry them safely.

It is, therefore, an object of the present invention to provide a hand carrier for cans or bottles which can be made with lesser amount of paper material than the conventional box-type hand carriers and which experts a very strong gripping force on the cans or bottles.

It is a further object of the present invention to provide a hand carrier which is adapted to grip the upper end of cans or bottles in a manner which allows them to be carried safely.

It is still another object of the present invention to provide a hand carrier which can be easily assembled merely by folding a pasteboard cut in a predetermined configuration without using staples or any kind of adhesive.

Other objects and advantages of the present invention will be apparent from the following description and the accompanying drawings.

FIG. 1 is a perspective view of the hand carrier according to the present invention shown in the state in which it is used to carry cans or bottles;

FIG. 3 is an enlarged partial view best showing the gripping engagement between frusto-conical grippers of the present hand carrier and circumferential projections of cans and bottles;

As shown in FIG. 1, the hand carrier 10 of the present invention is adapted to grip the upper ends of cans 14 or bottles 12. The use can carry the gripped cans or bottles by the hand carrier 10 by passing his fingers through an elongated grasping hole 32. As apparent from FIG. 1, the major portion of the bodies of the cans and bottles is not covered by the hand carrier 10 of the present invention, and therefore the amount of paper material used for making the hand carrier can be reduced to much less than that required for the conventional box-type hand carrier. Further, as almost the whole body portion of the cans and bottles held by the present hand carrier 10 are in exposed condition, there is not visual obstruction such as the side walls of the conventional box-type hand carrier to prevent markings etc. on the cans and bottles from being seen and, therefore, the advertizing effect is greatly increased by the use of the present hand carrier.

Figure 2:
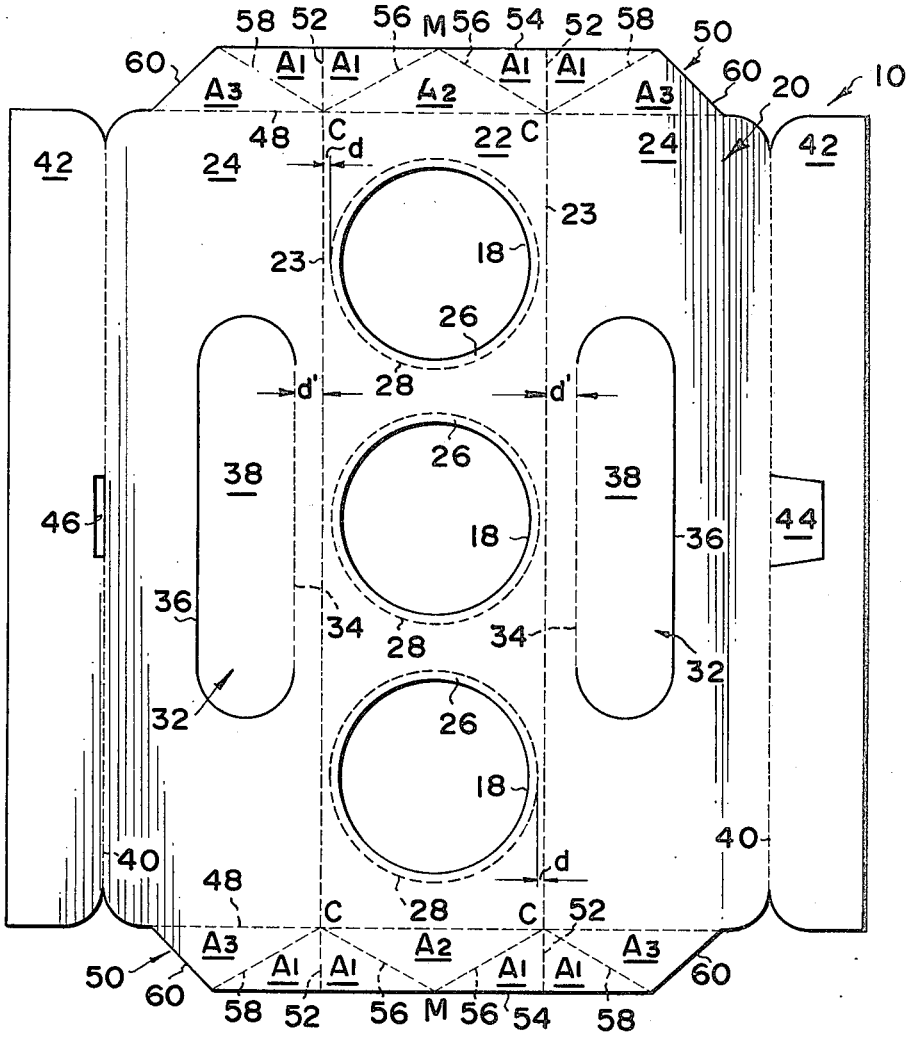
FIG. 2 is a developed view of the hand carrier according to the present invention.

FIG. 2 shows the flatly developed condition of the present hand carrier 10 used for carrying cans. The hand carrier for cans is identical to that for bottles except for the diameter of the gripping circular holes 18 and the distance "d'".

The hand carrier 10 of the present invention is made from a thick sheet 20 of, for example, pasteboard, plastic sheet or the like. The thickness and quality of the material of the sheet 20 are so determined that the sheet 20 has sufficient strength and stiffness to firmly grip cans and bottles and carry them safely.

In the center of the thick sheet 20, generally of pasteboard is provided a bottom wall 22 for the hand carrier 10. The bottom wall 22 includes at least one circular gripping hole 18. The number of the gripping holes 18 is determined on the basis of the strength and stiffness of the thick sheet or pasteboard 20 and the weight of the cans to be carried. The distance between adjacent holes 18 is so determined that cans gripped in the holes 18 do not strike against each other.

Figure 5:
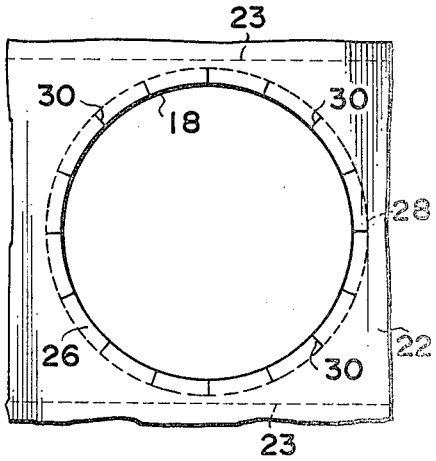
FIG. 5 is an enlarged view of an annular region defined by a circular gripping hole and a second circular scoring line and shows its flat condition prior to the insertion of a can or bottle and to the formation of the fursto-conical gripper.

As shown in FIG. 3, the can (or bottle) is held in the circular gripping hole 18 by a frusto-conical gripper 26 from the underside of a circumferential projection 27 (for example, the crown cap of a bottle or the projected edge on either end of a can). The frusto-conical gripper 26 is originally in flat condition as shown in FIG. 5 and is transformed into the upstanding condition as shown in FIG. 3 simultaneously with the insertion of the can or bottle into the circular gripping hole 18 from the underside of the bottom wall 22. To make the frusto-conical gripper 26 easily formable, a second circular scoring line 28 is provided concentrically with the circular gripper hole 18. The diameter of the circular gripping hole 18 should be determined smaller than that of the circumferential projection 27 of the can or bottle and the diameter of the second circular scoring line 28 should be determined larger than that of the projection 27. Therefore, an annular region 26 defined between the circular gripping hole 18 and the second circular scoring line 28 can be transformed into the frusto-conical gripper 26. As shown in FIG. 5, it is preferable to provide radial slits 30 arranged at equal circumferential intervals in the annular region 26 to make the region 26 easily expandable when the can or bottle is inserted into the gripping hole 18.

Figure 4:
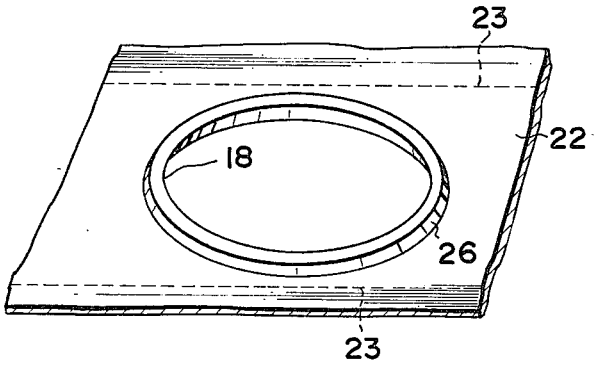
FIG. 4 is an enlarged view of a fursto-conical gripper which is initially press-formed simultaneously with the cut of the pasteboard.

The frusto-conical gripper 26 may also be preliminarily pressformed as shown in FIG. 4 to ensure the can or bottle can be easily inserted into the circular gripping hole 18. In this case, it is preferable to make the height of the press-formed gripper lower than the fully upstood condition as shown in FIG. 3. It is also preferable to provide radial slits 30 as shown in FIG. 5 in the pressformed gripper 26 of FIG. 4.

As shown in FIG. 2, a side wall 24 is provided along the full length of either side of the bottom wall 22 via first scoring lines 23. The clearance "d" between the first scoring line 23 and the second circular scoring line 28 should be determined as small as possible so as to increase the stiffness of the closest portion between the first and second scoring lines. The clearance "d" is determined as about 0.5 mm in the present embodiment.

Each of the side walls 24 is provided with an elongated grasping hole 32 closed by a flap 38. The flap 38 is attached to the lower peripheral portion of the grasping hole 32 via a third straight scoring line 34 parallel to the first scoring line 23 and is separated from the remaining peripheral portion thereof by a slit 36. The flap 38 formed by the third straight scoring line 34 and the slit 36 can be inwardly bent as shown in FIG. 1, when the user pass his fingers into the grasping hole 32. When the user carries the cans or bottles by the hand carrier 10, it is desirable to diminish the swing motion of the cans or bottles in the gripping holes 18. To this end, the distance "d'" between said first and third scoring lines 23 and 34 is so determined that it substantially equals the sum of the height "$h_1$" of the frusto-conical gripper and the height "$h_2$" of the circumferential projection 27 of the cans or bottles as shown in FIG. 3. As the flap 38 is provided at such a distance "d'", it can press the top faces of the cans or bottles when it is inwardly bent by the user's fingers, thus, the swing motion of the cans or bottles can be diminished.

As shown in FIG. 2, a reinforcing member 42 is provided along the full length of each of the side walls 24 via fourth scoring lines 40. The reinforcing members 42 are bent inwardly and brought into contact with each other as shown in FIG. 1 when the hand carrier 10 is folded into the state in which it is used and thus the reinforcing member 42 increase the longitudinal rigidity of the hand carrier 10.

One of the reinforcing members 42 is provided with a snapping flap 44 which can be pivoted around the fourth scoring line 40. The other reinforcing member 42 is provided with a slot 46 which is positioned adjacent to the fourth scoring line 40 and is adapted to receive the flap 44 therein.

Lastly, reinforcing ear portions 50 are provided along opposite ends of the bottom wall 23 and the side walls 24 via fifth scoring lines 48''. These reinforcing ear portions form the end walls of the hand carrier 10 when it is folded into the usable state and increase the tortional rigidity and improve the appearance of the present hand carrier 10.

The two ear portions 50 are identical and therefore the following detailed explanation will be limited to one ear portion 50.

The configuration of the reinforcing ear portion 50 is an isosceles trapezoid having its base on the fifth scoring line 48. The reinforcing ear portion 50 includes sixth scoring lines 52 lying on the extensions of the first scoring lines 23, seventh scoring lines 56 connecting the mid point M of the outer edge 54 of the ear portion 50 and the two intersecting points C, C of the first and fifth scoring lines 23 and 48, and eighth scoring lines 58 symmetrical with the seventh scoring lines 56 with respect to the sixth scoring lines 52. The ear portion 50 is divided into a plurality of triangles, that is, four triangles $A_1$ defined by said sixth, seventh and eighth scoring lines 52, 56 and 58 and the outer edge 54, one triangle $A_2$ defined by said fifth and seventh scoring lines 48 and 56, and two triangles $A_3$ defined by said fifth and eighth scoring lines 48 and 58 and oblique edge 60 of the ear portion 50.

When the hand carrier 10 is folded into the usable state, the triangles $A_1$ are bent inwardly and the triangles $A_2$ and $A_3$ are bent substantially normal to the bottom wall 22 and side walls 24 and thus form one end wall of the hand carrier 10.

The following is an explanation of the method of folding the present hand carrier 10 into the form in which it is used.

Firstly, both reinforcing members 42 are bent inwardly along the fourth scoring lines 40, and then both side walls 24 are bent inwardly to form a triangular prism body by the bottom wall 22 and the side walls 24. During the formation of the triangular prism body of the hand carrier 10, the triangles $A_1$ are bent inwardly and the triangles $A_2$ and $A_3$ are bent substantially normal to the bottom wall 22 and the side walls 24. After the completion of forming the triangular prism body of the hand carrier 10, the flap 44 is inserted into the slot 46. Thus, the hand carrier of the present invention can be easily folded into usable form without using staples or any kind of adhesive.

The insertion of cans or bottles into the gripping holes 18 may be carried out any time before or after the folding of the hand carrier 10.

As apparent from the foregoing descriptions, the hand carrier of the present invention is very simple in structure and very small in size as compared with the conventional box-type hand carrier. Therefore, the amount of paper or plastic material used for making the hand carrier of the present invention can be reduced to much less than that used for making the box-type hand carrier.

Further, the gripping mechanism of the frusto-conical gripper and the circumferential projection of the present hand carrier has very strong resisting force against the drawing out force of the can or bottle, since the can or bottle is tightly gripped by the frusto-conical gripper from the underside of the circumferential projection. Therefore, the user can carry the gripped cans or bottles safely.

Almost the whole body portions of cans or bottles carried in the present hand carrier are exposed to sight, since the carrier has no side walls similar to those of the conventional box-type hand carrier. Consequently, the labels, markings etc. on the cans or bottles are freely visible and the advertising effect is greatly enhanced.

I claim:

1. A hand carrier made of a thick sheet for carrying cans or bottles by gripping their circumferential projections, characterized in comprising:

a bottom wall (22) and two side walls (24) provided one along either side of the bottom wall (22) via first scoring lines (23), at least one circular gripping hole (18) provided in the bottom wall (22) for gripping a can or bottle and having a smaller diameter than that of the circumferential projection (27) of the can or bottle to be carried, a second circular scoring line (28) formed concentrically with each of the circular gripping holes (18) and having a diameter larger than that of the circumferential projection (27) of the can or bottle to be carried, an annular region (26) defined between the circular gripping hole (18) and the second circular scoring line (28) and being transformable into a frustoconical gripper upwardly extending from the second circlar scoring line (28) simultaneously with the insertion of the can or bottle into the circular gripping hole (18) from the underside of the bottom wall (22), the frustoconical gripper being engageable with and tightly gripping the circumferential projection of the can or bottle from the underside thereof, reinforcing ear portions (50) provided one on each end of the bottom wall (22) and the side walls (24) via additional scoring lines (48), the configuration of the reinforcing ear portion (50) being an isosceles trapezoid having its base on the additional scoring line (48), each reinforcing ear portion (50) having further scoring lines (52) lying on the extensions of the first scoring lines (23), mid scoring lines (56) connecting the mid point (M) of the outer edge (54) of the ear portion (50) and two intersecting points, (C, C) of the first and the additional scoring lines (23) and (48), and lateral scoring lines (58) symmetrical with the mid scoring lines (56) with respect to the further scoring lines (52), and first triangular shaped portions ($A_1$) defined by said further mid and lateral scoring lines (52, 56 and 58) and the outer edge (54) of the ear portions (50) being bent inwardly, and second triangular portions ($A_2$) defined by said additional and further scoring lines (48 and 56) and third triangular portions ($A_3$) defined by said additional and lateral scoring lines (48 and 58) and oblique line (60) of the ear portions (50) being bent substantially normal to the bottom wall (22) and the side walls (24), when the hand carrier is folded into its usable form.

2. A hand carrier for cans or bottles as defined in claim 1 in which said annular region (26) is press-formed into the frustoconical gripper which rises from the bottom wall (22) to some extent to make it easy to insert the can or bottle into the circular gripping hole (18).

3. A hand carrier for cans or bottles as defined in claim 1 in which said annular region (26) is provided with radial slits (30) arranged at equal circumferential intervals.

4. A hand carrier for cans or bottles as defined in claim 1 in which an elongated grasping hole (32) closed by a flap (38) is formed in each of the side walls (24), the flap (38) being attached to the lower peripheral portion of the hole (32) by a third straight scoring line (34) parallel to said first scoring line (23) and being separated from the remaining peripheral portion thereof by a slit (36).

5. A hand carrier for cans or bottles as defined in claim 4 in which a distance "d'" between said first and third scoring lines (23) and (34) is so determined that it substantially equals the sum of the height "$h_1$" of said frustoconical gripper and the height "$h_2$" of the circumferential projection (27) of the can or bottle.

6. A hand carrier for cans or bottles as defined in claim 1 in which reinforcing members (42) are provided one on each side wall (24) via fourth scoring lines (40), a flap (44) is so formed in one of the reinforcing members (42) that its pivoting edge lies on the fourth scoring line (40), and a slot (46) engaging with the flap (44) is formed in the other reinforcing member (42) at a position adjacent to the fourth scoring line (40).

7. A hand carrier for cans or bottles as defined in claim 1 in which the thick sheet (20) is a sheet of pasteboard or a plastic sheet having sufficient strength and stiffness to support the cans or bottles safely.

* * * * *